US005839827A

United States Patent [19]

Ogata et al.

[11] Patent Number: 5,839,827

[45] **Date of Patent: *Nov. 24, 1998**

[54] AGITATING ELEMENT FOR MIXING APPARATUS AND THE MIXING APPARATUS EQUIPPED WITH THE AGITATING ELEMENT

[75] Inventors: Toshio Ogata; Noboru Iwata, both of Okayama, Japan

[73] Assignee: Kuraray Co., Ltd., Kurashiki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 820,349

[22] Filed: Mar. 12, 1997

[30] Foreign Application Priority Data

Mar. 28, 1996 [JP] Japan ..... 8-074379

[51] Int. Cl.[6] ..... B01F 7/28; B01F 7/32

[52] U.S. Cl. ..... 366/325.94; 366/309; 422/135

[58] Field of Search ..... 366/64–67, 96–99, 366/309, 312, 325.8, 325.4, 325.5, 325.92, 325.93, 325.94, 331; 422/135

[56] References Cited

U.S. PATENT DOCUMENTS

| | | | |
|---|---|---|---|
| 51,160 | 11/1865 | Edwards | 366/309 X |
| 377,443 | 2/1888 | Walden | 366/325.4 X |
| 448,375 | 3/1891 | Shepard | 366/328.8 |
| 654,961 | 7/1900 | Emory | 366/325.4 |
| 816,887 | 4/1906 | Snigo | 366/309 X |
| 823,612 | 6/1906 | Mayfield | 366/309 X |
| 959,726 | 5/1910 | Fish | 366/325.4 X |
| 1,039,779 | 10/1912 | Miles | 366/309 X |
| 1,708,493 | 4/1929 | Brinkley | 366/325.94 X |
| 2,243,317 | 5/1941 | Phelan | 366/325.94 X |
| 3,337,191 | 8/1967 | Gall | 366/325.4 |
| 3,544,081 | 12/1970 | Eckhardt | 366/325.94 X |
| 4,104,737 | 8/1978 | Brailsford | 366/312 X |

FOREIGN PATENT DOCUMENTS

| | | |
|---|---|---|
| 8324853U | 10/1983 | Germany . |
| 58-3481 | 1/1983 | Japan . |
| 58-51962 | 11/1983 | Japan . |
| 61-14853 | 4/1986 | Japan . |
| 1-34444 | 7/1989 | Japan . |
| 6-55269 | 7/1994 | Japan . |

OTHER PUBLICATIONS

Kukuhan–Souchi no Sekkei to Sousa (Design and Operation of Agitating Apparatus, Bessatsu Kagaku–Kogyo, Kagaku–Kogyo–sha, vol. 14, No. 7, pp. 4–11 (1970).

Patent Abstracts of Japan, vol. 4, No. 89, 25 Jun. 1980.

*Primary Examiner*—Charles E. Cooley

*Attorney, Agent, or Firm*—Jones, Tullar & Cooper, P.C.

[57] ABSTRACT

There is provided a mixing apparatus having a mixing vessel which is substantially in the form of a cylinder and an agitating element, the agitating element including at least two bars and at least one connecting member which connects the bars to each other to form the agitating element such that loci of the bars do not essentially coincide with each other when the bars are rotated around an axis of the mixing vessel.

8 Claims, 5 Drawing Sheets

AGITATING ELEMENT FOR MIXING APPARATUS AND THE MIXING APPARATUS EQUIPPED WITH THE AGITATING ELEMENT

BACKGROUND OF THE INVENTION

1. Field of the Invention

The present invention relates to an agitating element (or a stirring element) and a mixing apparatus equipped with the element, for example a reaction apparatus. Particularly, the present invention relates to an agitating element comprising a plurality of bars and a mixing apparatus such as a polymerization apparatus comprising such an element, to which the present invention is not exclusively limited.

The agitating element and the mixing apparatus according to the present invention are very simple in their structures, and agitating effects derived therefrom are not affected by change of a liquid level within a vessel. Further, substantially no block mass is formed when the mixing apparatus is used for polymerization. Thus, the agitating element and the mixing apparatus according to the present invention are so versatile that they can be widely used in various fields, for example in various batch-wise and continuous polymerization processes. Therefore, the agitating element and the mixing apparatus according to the present invention will be explained mainly with reference to an agitating element and a mixing vessel which can be used for a polymerization processes, but it is to be understood that the present invention is not exclusively limited to those used for such processes.

2. Description of the Related Art

Hitherto, various polymerization apparatuses have been developed, and particularly various agitating elements used in such apparatuses have been improved. The agitating element is generally classified into the following two types; one is a radial flow type such as a paddle agitator and a turbine agitator, and the other is an axial flow type such as a propeller agitator (see for example "Kakuhan-Souchi no Sekkei to Sousa (Design and Operation of Agitating Apparatus)", Bessatsu-Kagaku-Kogyo, Kagaku-Kogyosha, vol. 14, No. 7 pp. 4–11 (1970)).

When the radial flow agitating type element is used in a mixing vessel, a strong liquid flow is formed along a rotating direction of the element due to a centrifuge effect of rotation of the agitating element. The strong flow results in a horizontal swirl, which lowers a liquid level in the vessel and entrains air into the inside of the liquid. Since the core portion of the swirl rotates in the form of a rod, a mixing effect in such a portion is not sufficient. In order to improve the effect, baffle plates are provided in the mixing vessel. The baffle plates accelerate mixing along an axial direction of the element, and improve the mixing effect which corresponds to increase of the power consumed by the element. However, the baffle plates are effective for liquid having a low viscosity, and they have a different problem that stagnant portions are formed behind the baffle plates when used for liquid having a high viscosity. Thus, the baffle plates are not necessarily effective.

On the other hand, when the axial flow agitating type element is used in a mixing vessel, a strong liquid flow tends to be formed along a direction of a rotating shaft of the element. Particularly, when the baffle plates are used, such a tendency is remarkable, so that the liquid flows as a clearly recirculating stream in the vessel. When compared with the radial flow agitating type element, the axial flow agitating type element fluidizes the liquid in a much broader region in the vessel, which leads to the possibility that a relatively smaller agitating element can be used in a large volume vessel. However, such an agitating element effectively provides the possibility only for the liquid having a low viscosity.

The agitating element as described above generally is fixed to a rotative shaft at a certain position in the vessel and thus with respect to a vertical position. This means that the position of the agitating element with respect to the liquid surface level in the vessel highly affects the mixing effect. Thus, when such an agitating element is used for a polymerization process, for example polymerized product qualities are highly depend on the position of the element.

Further, the above agitating element requires baffle plates so as to promote the mixing effect. When baffle plates are added to the mixing vessel, the mixing effect is improved, but stagnant portions are formed behind the baffle plates. For example, when a polymerization process is continued for a long period using the agitating element together with the baffle plates, polymer block masses are likely to be formed and grow in the stagnant portions, and such block masses may interrupt the polymerization operation.

A screw agitator or a helical ribbon agitator is used for mixing of highly viscous liquid. For example, Japanese Patent Kokoku Publication No. 14853/1986 discloses a spiral agitator unsupported at one end; Japanese Patent Kokoku Publication No. 34444/1989 discloses an agitator which includes a plurality of double-spiral blades on a rotary shaft; and Japanese Patent Kokoku Publication No. 51962/1983 uses stirring blades fixed to a rotative shaft which blades include scrapers. Japanese Patent Kokoku Publication No. 55269/1994 discloses an agitator comprising a pair of screws which are engaged with each other. However, these agitating elements are very complicated in their structures and generally require large power for agitation, and their applications are limited by the viscosity of liquid to which they are applied.

A flow generated by each of the agitating elements described above is mainly a vertically recirculating stream (i.e. along a direction of a rotating shaft). When such an agitating element is used in a mixing vessel in a batch-wise operation mode, any liquid portion in the vessel has substantially the same residence time. However, when such an agitating element is used in a continuous operation mode (i.e. continuously feeding to and continuously withdrawing from the vessel), various liquid portions in the vessel have different residence times (i.e. there is a broad residence time distribution). For example, when a reaction is continuously carried out using the agitating element, various liquid portions have different reaction conversions from a microscopic view point. In the case of a polymerization operation using such an agitating element, the continuous operation produces polymer products having various degrees of polymerization.

Japanese Patent Kokoku Publication No. 3481/1983 discloses a polymerization apparatus aimed at a so-called piston-flow type apparatus in which highly viscous liquid is used without formation of stagnant portions. In the apparatus, a center axis of a vessel is made eccentric from a rotating shaft for an agitating element, and porous plates and wings are equipped, the latter acting as scrapers which remove polymers attaching to the vessel walls.

Although it is expected that the polymerization apparatus described above achieves its own objects (i.e. the provision of the piston-flow type apparatus) to some extent, the apparatus is still complicated in its structure so that it is considerably difficult to use the apparatus on an industrial scale.

SUMMARY OF THE INVENTION

It is, therefore, an object of the present invention to provide an agitating element and a mixing apparatus (such as a polymerization apparatus) used in a batch-wise mode or a continuous mode which are simple in their structures, which form fewer block masses, preferably substantially no block mass a and which are applied to, liquid having a viscosity within a broad range.

According to a first aspect of the present invention, there is provided an agitating element which comprises at least two bars and at least one connecting member which connects the bars to each other to form the agitating element such that loci of the bars do not essentially coincide with each other when the bars are rotated around an axis of the mixing vessel substantially in the form of a cylinder. The loci are paths followed by the bars when they are rotated.

In other words, the present invention provides an agitating element comprising at least two bars and at least one connecting member which connects the bars in a direction across the bars and preferably perpendicularly to each other, at least one of which includes a connection mechanism (such as a coupling), and which is to be fixed through the connection mechanism to a rotative shaft corresponding to an axis of a mixing vessel substantially in the form of a cylinder, fixing being such that the mechanism and the axis align with each other, whereby loci of the bars are not identical with each other when the shaft and thus the bars are rotated around the axis of the mixing vessel. Such fixing means that the agitating element is non-symmetrical about the rotative shaft of the mixing vessel.

According to a second aspect of the present invention, there is provided a mixing apparatus comprising a mixing vessel which is substantially in the form of a cylinder and the agitating element described in the first aspect of the present invention, in which apparatus and the agitating element is so mounted onto the mixing vessel through the connection mechanism that loci of the bars are not coincident with each other when the shaft is rotated around the axis of the mixing vessel.

In one preferred embodiment, the agitating element according to the present invention comprises two bars which are substantially parallel to the axis of the mixing vessel and which are connected with each other at any two opposing positions, preferably near or at their both ends, using two connecting members.

DETAILED DESCRIPTION OF THE INVENTION

Figure 1:
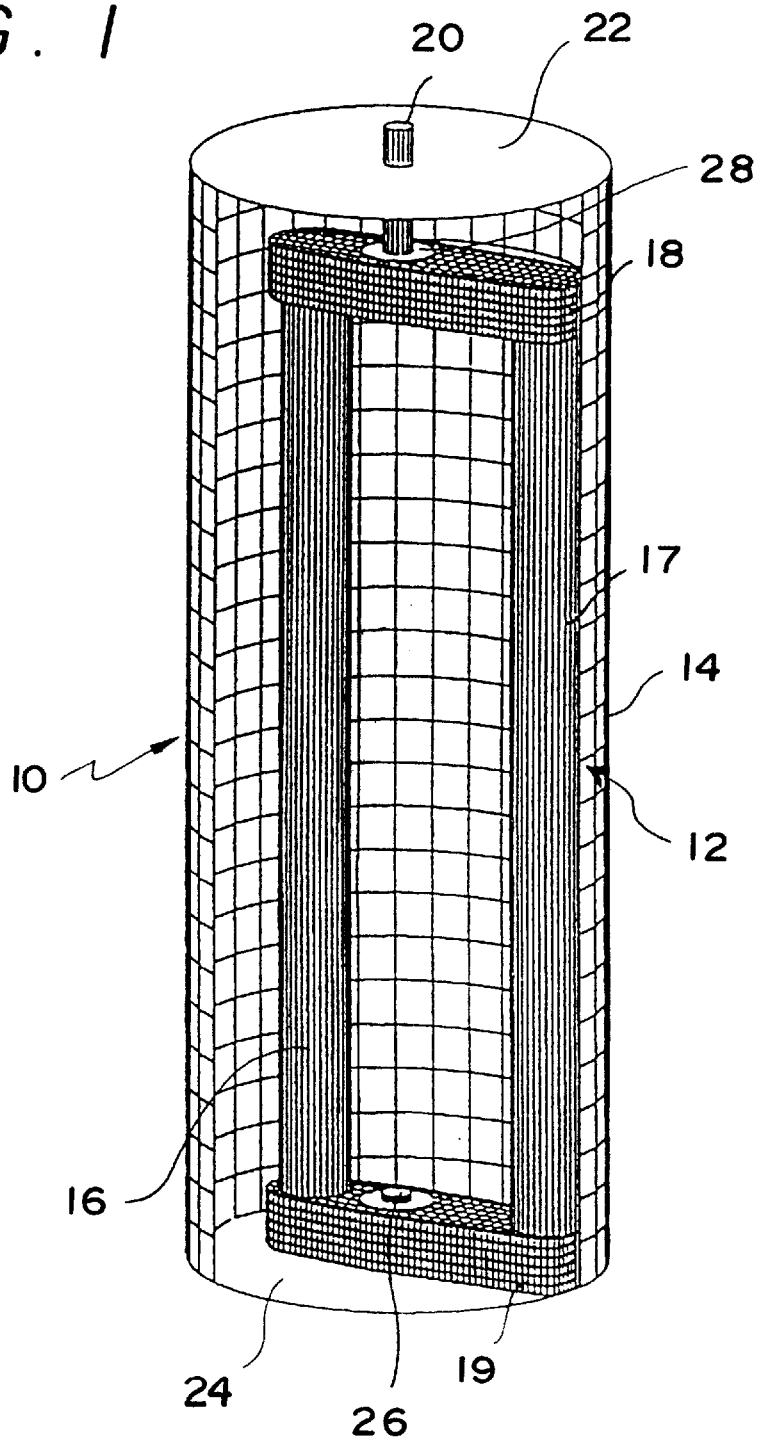
FIG. 1 schematically shows a perspective view of one embodiment of a mixing apparatus according to the present invention which is shown partially cut away so that an agitating element according to the present invention is seen in place in a vessel.

One of the features of the present invention resides in using at least two bars. There is no specific limitations on the bar provided that it has a length (or a height) and a width (or a thickness), namely the bar is of at least substantially two-dimensional and thus it can move liquid when it moves through the liquid along a certain direction. The bar may have a longer length relative to a diameter of a mixing vessel in a preferable embodiment. The bar described above may be in any form, preferably in the form of a column or a prism and more preferably in the form of a right column or a right prism. The bar may have any shape in its cross-section perpendicularly to its axis. For example, the cross-section may be a circle, an oval, a polygon such as a triangle, a rectangle and a hexagon and so on. The bar may be hollow or solid. When the bar is in the form of a circular column, its diameter may be in the range of preferably between 15% and 20% and more preferably between 17% and 18 % of an inner diameter of the vessel to which the agitating element is applied. When the bar does not have a circular cross section, an equivalent diameter may be used in place of an actual diameter. The bar may have a ratio of its diameter to its length in the range preferably between 1/5 and 1/20 and more preferably between 1/9 and 1/18. The bar may be made of any material provided that it has sufficient strength for effective mixing and sufficient resistance to the liquid to be mixed. The bar may be made of for example, a metal. Each bar usually has the same length. The number of bars are usually two, but it may be optionally three or more. When more than two bars are used, they are so connected that the ends of the bars are on line. In a preferable embodiment, all of the bars are connected together in parallel by two connecting member so that the ends of the bars are aligned on each of the connecting members.

The bars are connected with the at least one connecting members perpendicularly to each other. There is no specific limitation on the connecting member, and the above features as to the bar are generally applied as long as no adverse effect results. There is no limitation on the position at which the connecting member connects the bars. In principle, the connecting member(s) should connect the bars so that each connection between them has an optimum strength. For example, when only a single connecting member is used, it preferably connects the bars at their middle points. When two connecting members are used, as usual in most cases, the bars are preferably connected by the connecting members at their opposed ends (namely at the top ends and the bottom ends of the bars). In this agitating element, it is preferable that also both ends of each connecting member connect the bars. The number of connecting members may be one, but it is usually at least two in order to ensure that no particularly weak portions are formed in the agitating element. When the number of connecting members is more than two, two of the members connect the bars at both their ends and the rest of the members connect the bars between the two members so that all of the connecting members divide the bars into a plurality of bar portions each having the same length. Especially, when the bars are relatively long, the number of connecting members may be three or four or more. At least one of the connecting members has the connecting mechanism which makes the agitating element possible to be non-symmetrical about the axis of the mixing vessel. When a single connecting member is used which connects bars at both its ends, the connecting mechanism is positioned so that the mechanism is deviated from the center of the member. When more than one connecting member is used which connect bars at both their ends, at least one of the members (usually the uppermost member) has the connecting mechanism positioned so that it is deviated from its center.

Thus, the agitating element according to the present invention is composed of at least two bars spaced from each other/one another and at least one connecting member which connects the bars along a direction across the bars and preferably perpendicularly to each other, and at least one of the connecting members is so constructed that it has the connection mechanism which makes it possible to fix the agitating element onto the shaft which rotates at the center of the circular cross section of the mixing vessel so that the loci formed by the bars are not coincident with each other.

At least one of the bars may be non-parallel to the axis of the mixing vessel provided that such a non-parallel bar does not interrupt the rotation of the agitating element. However, at least the outermost bar (i.e. the bar which is positioned outermost from the axis of the mixing vessel, or the bar which rotates so as to form a largest cylindrical locus) is preferably positioned parallel to the axis, so that, for example, in the case of polymerization, the bar may function to prevent any polymer product from attaching to walls of the vessel and/or function as a scraper which wipes away polymer product attaching to walls of the vessel if any when a clearance which is defined as a distance between the vessel inside wall and an outermost side of the bar is sufficiently small. In other words, the mixing apparatus according to the present invention may have a self-cleaning mechanism.

A width of the clearance as defined above depends on the individual system to be mixed, but preferably is in the range between 0.1% to 0.5% and more preferably in the range between 0.2% to 0.4% of an inner diameter of the mixing vessel. The smaller the clearance is, the better the self-cleaning effect (i.e. prevention of polymer mass attaching and/or polymer mass growing) is. However, the smaller clearance leads to an increase of a shearing stress in the clearance, which increases power consumption by the agitating element. Conversely, when the clearance is larger, the power consumption decreases and the self-cleaning effect is reduced. The explanations about the clearance as described just above are also applicable to a clearance between the connecting member and the inside bottom surface of the vessel when the connecting member is positioned at the bottom ends of the bars and the bottom surface of the vessel is flat.

Figure 2:
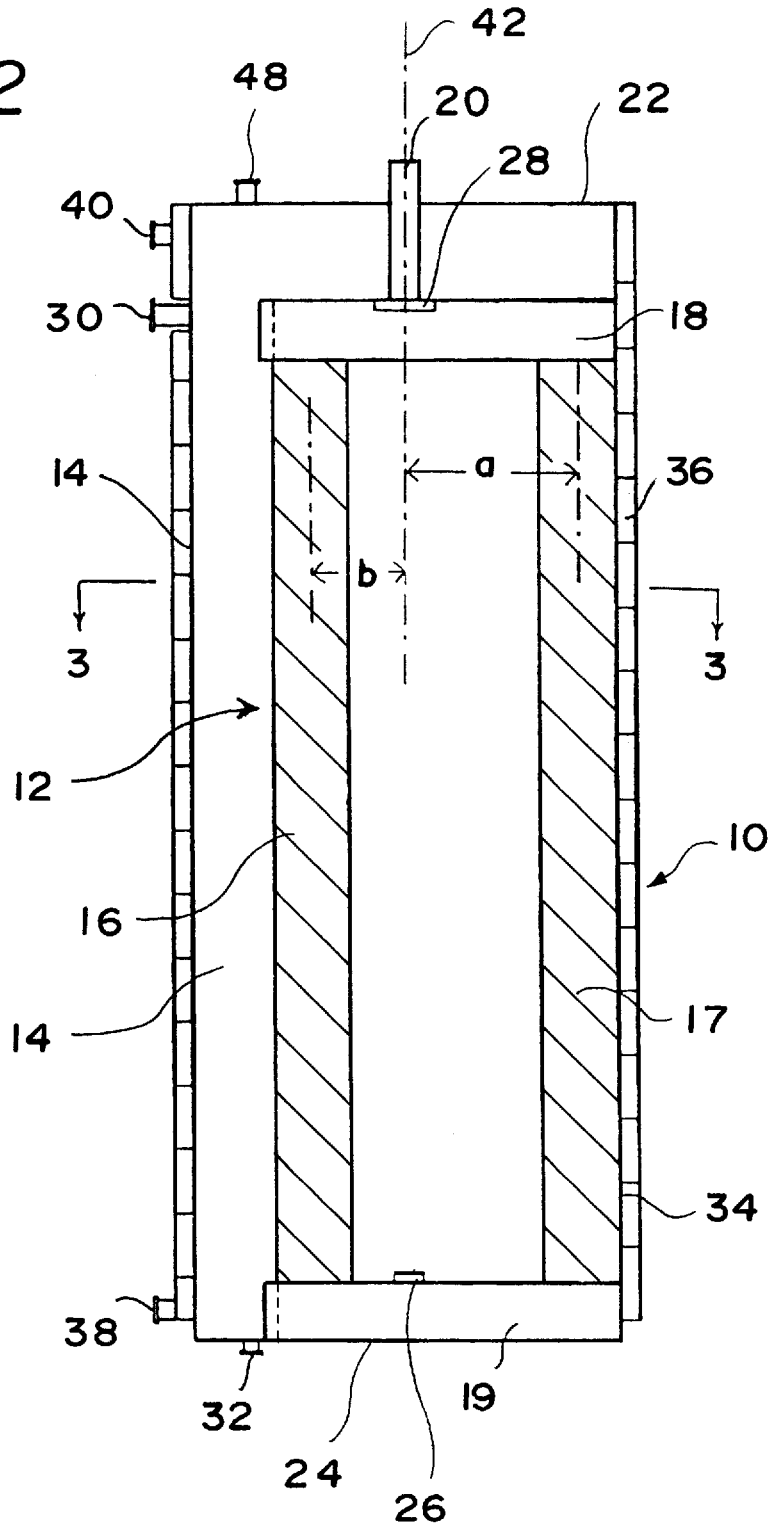
FIG. 2 schematically shows a front view of the mixing apparatus equipped with the agitating element according to the present invention as shown in FIG. 1 in which the vessel is shown in a cross-sectional view so that the agitating element is seen.

In a preferred embodiment according to the present invention, in order that loci of the bars are not essentially coincident with one another/each other, i.e. not identical to each other in their shapes, sizes and positions when the agitating element is rotated around the axis of the vessel, the agitating element is mounted onto the vessel such that the center axis between the two side bars is offset (or deviated) from the axis of the vessel and the element is fixed to a shaft corresponding to the axis of the vessel which is rotated by means of a driving mechanism comprising for example a motor. When explained with reference to an agitating element comprising two bars as schematically shown in FIG. 2, a distance a between the center of the vessel and the center of the outermost bar is unequal to a distance b between the center of the vessel and the center of the innermost bar.

In order to sufficiently achieve the effects of the present invention, a distance (a-b)/2 which corresponds to a distance between the axis of the vessel and the center between the innermost and the outermost bars is preferably in the range between 6% and 12% and more preferably in the range between 8% and 10% of the inside diameter of the vessel, which effectively deviates the center of the agitating element from the axis of the vessel. In combination this deviation with the outer diameter of the bar in the range of between 15 and 20% of the inner diameter of the vessel, loci areas perpendicular to the axis of the vessel which are formed by the rotating bars all together amount to more than about 90% of the cross sectional area of the vessel perpendicular to the axis, so that sufficient mixing effects of the liquid are ensured.

In a preferred embodiment, the mixing apparatus further comprises a top cover positioned on a top edge of the mixing vessel, which cover has a nozzle, such as, a nozzle through which vapor evaporated from the liquid in the vessel enters a condenser, a nozzle which supplies a polymerization inhibitor upon abnormal reaction and so on. In order that a top portion of the agitating element according to the present invention does not interfere with the function of such a nozzle (for example, in order to avoid closing by the top portion of the element) upon a stop of the agitating element due to a certain emergent event, the top portion of the agitating element is preferably 100 mm to 1000 mm and more preferably 300 to 600 mm below the top edge of the mixing vessel.

The mixing apparatus is composed essentially of the mixing vessel and the agitating element and a ratio (H/D) of a height of the vessel H (i.e. a length from the bottom to the top edge of the vessel) to an inner diameter of the vessel D may be practically $0.5 \leqq H/D \leqq 5.0$ and preferably $1.0 \leqq H/D \leqq 3.5$. The apparatus may be operated with a ratio 4D of a liquid height of the vessel L (i.e. a length from the bottom of the vessel to a liquid surface when an operational amount of liquid is charged into the vessel) to the inner diameter of the vessel D within practically $0.2 \leqq L/D \leqq 4.0$ and preferably $0.5 \leqq L/D \leqq 2.0$. Usually, the mixing vessel has an outer jacket so that liquid therein may be heated or cooled by means of any proper heating or cooling medium. For safety of polymerization inhibitor supply, a rupture disc may be optionally provided onto the mixing apparatus. In order to suppress formation of a block mass produced from a monomer reaction in a region above the top surface of the connecting member, an inlet port for liquid such as a monomer solution into the vessel is provided at a level which is preferably 10 to 50 mm and preferably 20 to 30 mm below the top surface of the agitating element. An outlet port for liquid such as a solution containing polymerization product from the vessel is usually provided on the bottom wall of the vessel. In order to expose the outlet port for as long a time as possible, the outlet port is provided to be as outermost as possible from the center of the vessel. In order to prevent formation of insufficiently mixed liquid portion in the vessel, the vessel may be operated with a ratio L/I of the liquid height of the vessel L to a length of the bar [I] (including a thickness(es) of the connecting member (s)) in the range preferably between 0.10 and 0.95 and more preferably between 0.70 and 0.90. A ratio L/H of the length of the bar L to the height of the vessel H may be preferably in the range between 0.70 and 0.95 and more preferably between 0.80 and 0.90.

The mixing apparatus according to the present invention is generally useful for any viscous liquid (including highly viscous liquid), and particularly effective for mixing a monomer solution for a polymerization reaction, and thus a polymerization solution. Basically, any monomer can be used in the present apparatus. Examples of a suitable monomer which is effectively polymerized using the mixing apparatus according to the present invention includes vinyl esters such as vinyl acetate, vinyl propionate, vinyl butylate, vinyl versate and vinyl pivalate. There is no specific limitation on a solvent which dissolves the monomer to prepare the monomer solution. For example, the solvent may include alcohols (such as methanol, ethanol and propanol), esters (such as ethyl acetate and methyl acetate), organic acids (such as acetic acid), acetone, benzene and toluene. There is no specific limitation on the viscosity of the liquid to be mixed such as the monomer solution, but the liquid preferably has a viscosity in the range practically between 50 and 5000 poise and perferably between 100 and 3000 poise.

Figure 3:
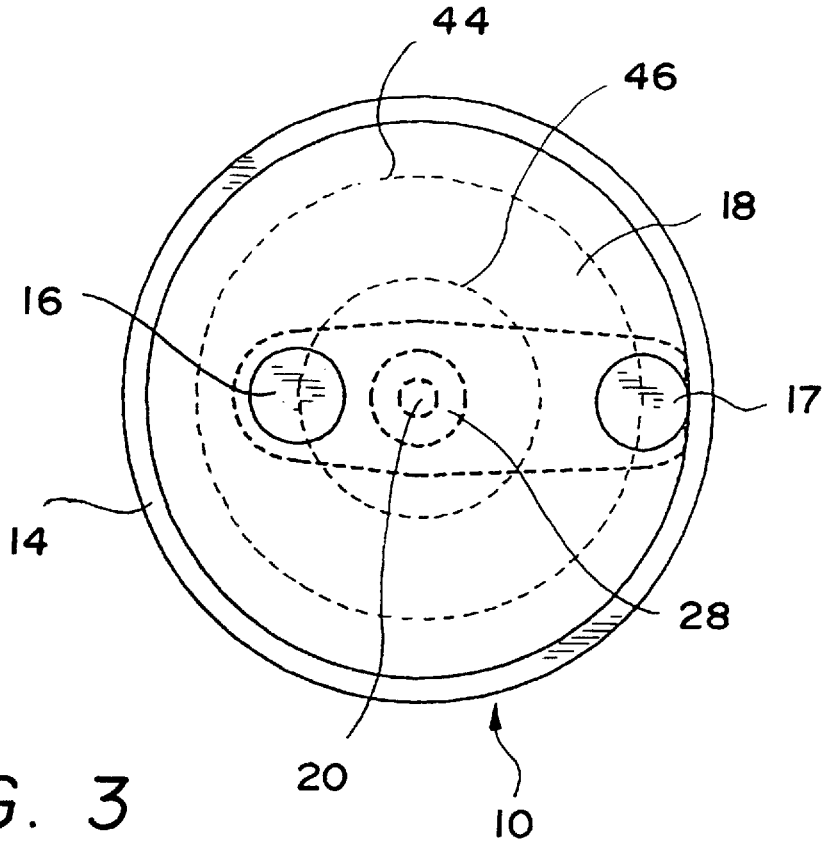
FIG. 3 schematically shows a cross-sectional view of the mixing apparatus shown in FIG. 1 which is taken along a line 3—3 in FIG. 2.

In a preferred embodiment, the agitating element according to the present invention preferably has substantially the same horizontal cross-section at any level along a direction of axis of the vessel except the connecting member(s) (see FIG. 3 in which the connecting member and the connecting mechanism are shown using dotted lines). This means that the mixing effects are substantially the same regardless of the levels of the liquid portions in the vessel, whereby any throughput and/or any processing period such as a reaction period may be selected while the same mixing effects are maintained. In addition, since the mixing effects are constant even when the liquid level is low, for example, at the beginning of an operation, the same mixing state is achieved until a liquid level has increased to a predetermined liquid level, which makes it easier to move the operation to a steady state in a shorter period.

Since the mixing apparatus according to the present invention uses no baffle plate, substantially no stagnant portion is formed in the vessel so that substantially no block mass is formed. Further, when the clearance between the vessel wall and the outermost bar is so small that the self-cleaning effect is available, the formation of the block mass is much more difficult.

In the mixing apparatus according to the present invention, rotation of the bars produces the mixing effects which in turn forms a rotational liquid flow along a substantially horizontal direction, whereby not much of, preferably substantially no vertical flow is formed or at least less mixing occurs along a vertical direction. Thus, power consumption is small. When liquid is continuously supplied to and withdrawn from the vessel, the liquid flows in substantially a so-called "piston flow" in the vessel. This means that the residence time distribution of the liquid in the vessel is very sharp (or narrow), so that in the case of a reaction operation, a converted product having substantially uniform properties is obtained.

Since the mixing apparatus according to the present invention has various advantageous features as described above, scale-up of the apparatus is easily carried out based on the principle of similarity. Further, the mixing effects are independent of the liquid level in the vessel so that mixing operation may be carried out at any selected liquid depth. Thus, the mixing apparatus is very useful not only for the batch-wise mode but also for the continuous mode in for example polymerization. In addition, the present mixing apparatus is operated stably for a long period substantially without formation of a block mass, which is important from an industrial viewpoint. Especially, the present mixing apparatus commercially ensures a stable polymerization operation.

The present invention will be, hereinafter, described further in detail by way of examples with reference to the accompanying drawings.

FIG. 1 shows a perspective view of one embodiment of a mixing apparatus 10 according the present invention and FIG. 2 shows a front view of FIG. 1. As seen from FIG. 2, the mixing apparatus 10 comprises an agitating element 12 and a mixing vessel 14 in the form of a cylinder. The agitating element 12 has two bars 16 and 17 parallel to each other which are connected at both their top ends and their bottom ends by connecting members 18 and 19 oriented perpendicularly to the bars 16 and 17. The connecting members 18 and 19 connect, at both their ends, the bars 16 and 17, but the connecting members 18 and 19 may extend a little beyond the top and bottom ends of the bar 16 because the extensions of the innermost bar do not adversely affect the self-cleaning effect. The vessel 14 has a rotative shaft 20 which extends through its top cover 22 at the center thereof, which shaft is connectable to a driving mechanism (not shown) which rotates the shaft 20 about an axis 42 of the vessel 14. The shaft 20 is connected to the upper connecting member 18 by means of a connection mechanism 28. Thus, the upper connecting member 18 is connected to the shaft 20 eccentrically from the center of the member 18 as seen from FIG. 1 or 2. The lower connecting member 19 is freely rotatively connected to the bottom wall 24 at the center thereof through a connecting mechanism 26 which is opposite to the shaft 20. The connecting mechanism 26 is not necessarily needed if the upper mechanism is sufficient to support the agitating element. By these connections as described above, when the shaft 20 is rotated, the bars 16 and 17 are rotated around the shaft 20 and thus about the axis 42 of the vessel, respectively so that the bar 17 forms a larger cylindrical locus 44 and the bar 16 forms a smaller cylindrical locus in the smaller locus 46 as shown in FIG. 3, namely these two loci are not coincident with each other. It is to be noted that the bars 16 and 17 are parallel to the axis 42 of the vessel 14 so that a clearance 34 (shown as a line due to its small size) between the inside of the vessel and the outermost surface of the bar 17 is kept substantially constant along a length of the bar 17. The mixing vessel 14 may further comprises a nozzle 48 through which, for, example, vapor passes from the liquid in the vessel to a condenser (not shown) or a polymerization inhibitor is supplied to the liquid.

FIG. 3 is a cross-sectional view of the mixing apparatus of FIG. 1 or 2. For easily understanding the two loci 44 and 46, which are shown using broken lines, which are formed by the centers of the rotating bars 16 and 17, respectively. As can be seen the loci formed by the bars are annular rings.

Figure 4:
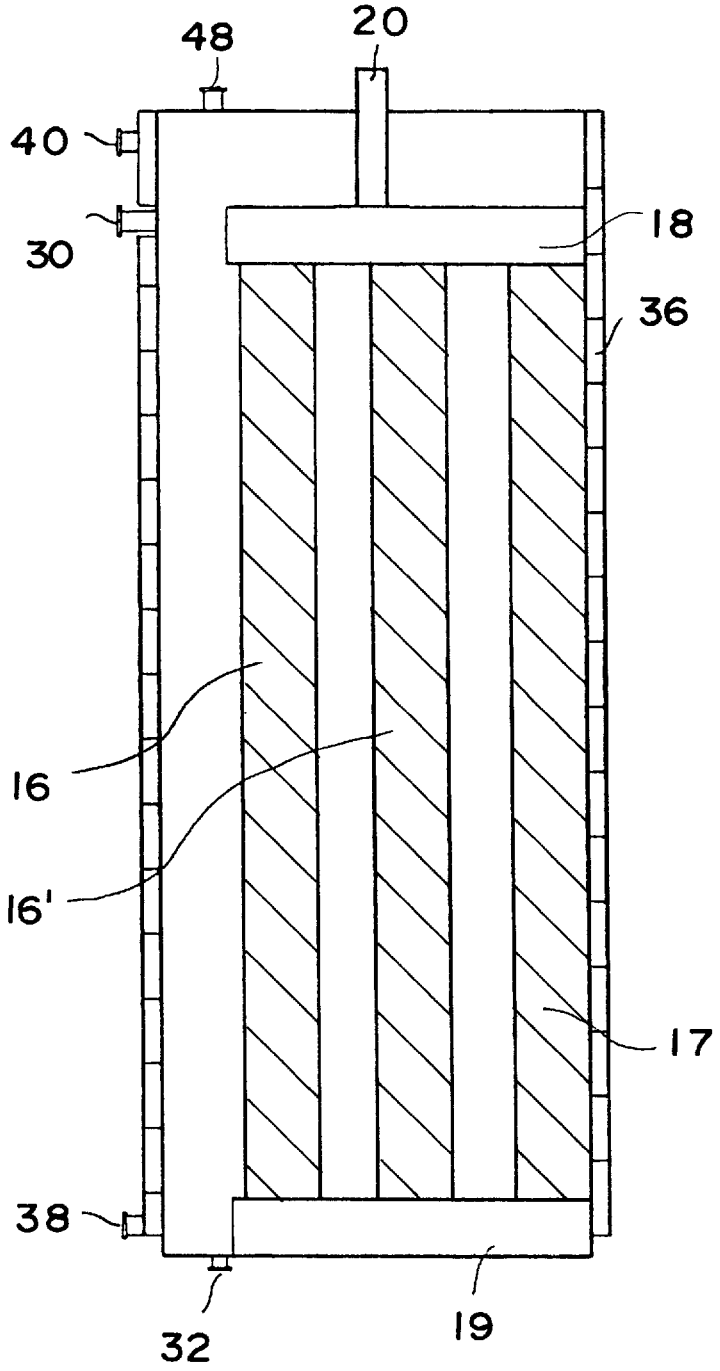
FIG. 4 schematically shows a front view of another embodiment of a mixing apparatus equipped with an agitating element according to the present invention in which a vessel is shown in a cross-sectional view similarly to FIG. 2.

FIG. 4 shows another embodiment of the mixing apparatus according to the present invention. This embodiment is similar to that of FIG. 2 except that the number of the bars is three, namely the agitating element has an additional bar 16' between the innermost bar 16 and the outermost bar 17.

The use of the mixing apparatus according to the present invention will be, hereinafter, described by way of a polymerization process as an example.

First, the inside of the mixing apparatus 10 is replaced with nitrogen, a monomer solution consisting essentially of a monomer to be polymerized and a predetermined amount of a solvent. The solvent is charged into the mixing vessel 14 to a predetermined level through an inlet 30 and then the solution is heated to a predetermined temperature while agitating, and the conditions (especially viscosity) of the solution is observed. The heating may be carried out with a jacket 36 around the vessel using steam or hot water which is supplied through an inlet port 40 and withdrawn through an outlet port 38. The number of revolutions of the agitating element depends on the conditions (especially viscosity) of the solution. On the one hand, when the number of revolutions is too small, mixing of the solution is not sufficient. On the other hand, when the number of revolutions is too large, power consumption for mixing rapidly increases. The number is usually in the range between 2 and 20 r.p.m., and preferably in the range between 5 and 15 r.p.m. When the polymerization operation is continuously carried out, the monomer solution is re-supplied continuously and at the same time withdrawal of the solution is started after a predetermined polymerization degree has been reached in the solution in the vessel. The solution is withdrawn through an outlet 32 using, for example, a gear pump (not shown). If necessary, a flow meter such as an oval type flow meter may be used for the withdrawal. The liquid level in the vessel may be controlled by adjusting the amount of the withdrawal. At least a portion of the withdrawn solution may be recirculated to the vessel so as to keep the liquid level constant in the vessel. In order to intentionally stop the polymerization, a means to add a polymerization inhibitor to the liquid may be provided with the mixing apparatus. For emergency purposes, any safety equipment such as a rupture disc may be also provided.

The agitating element or the mixing apparatus having the element according to the present invention is very simple in its construction and sufficient mixing is achieved regardless of the liquid level in the vessel. For example in the case of polymerization, mixing achieved by the present invention provides neither polymer attaching to the vessel walls nor block mass formation, so that stable polymerization is possible for an extended period. Further, the liquid stream in the vessel is substantially a piston-flow, which forms a polymer product having uniform properties and scale-up of the mixing apparatus is easy which can be used in the batch wise mode or continuous mode.

EXAMPLES

Example 1

Polymerization of vinyl acetate was carried out using a mixing apparatus 10 according to the present invention as shown in FIG. 1 which comprised an agitation element 12 and a cylindrical mixing vessel. The vessel had an inner diameter of 2300 mm and a height (which corresponds to a length from the bottom surface to the top edge of the vessel ) of 6000 mm. The element comprised two vertical bars 16 and 17 each in the form of a column having a circular cross section the outer diameter of which was 400 mm. The bars were so connected at both their ends by two connecting members 18 and 19 that a length of each bar was totally 5500 mm including the thicknesses of the connecting members 18 and 19 (300 mm each) at both its ends. The agitating element is mounted onto the vessel such that a length a between the center of the vessel and the center of the outermost bar 17 was 943 mm while a length b between the center of the vessel and the center of the innermost bar 16 was 510 mm.

The inside of the vessel was replaced with nitrogen, a monomer solution containing 83% by weight of vinyl acetate and 17% by weight of methanol and a trace amount of a polymerization initiator was charged into the vessel. The monomer solution was heated using a heat exchanger when supplied and a heating jacket 36 around the vessel through which hot water was recirculated. The polymerization was carried out continuously at a temperature of 65° C. with a liquid level from the vessel bottom of 4.2 m (thus a ratio of a liquid height to an inner diameter of the vessel was 1.8/1). The number of revolutions was set at 10 r.p.m. A polymerization conversion was controlled using an added amount of a polymerization catalyst which is calculated based on a composition of the monomer solution and the average residence time of the monomer solution in the vessel and so on. The polymerization operation was continued for one year while maintaining the polymerization conversion at about 64%, no block mass was formed and polyvinyl acetate resin having a polymerization degree of about 1700 was produced.

Example 2

Example 1 was repeated except that the ratio of the liquid height to an inner diameter of the vessel was 1.3/1. While the polymerization operation was continued for one year with a conversion of about 64%, no block mass was formed and polyvinyl acetate resin having a polymerization degree of about 1700 was produced.

Example 3

Example 1 was repeated except that the ratio of the liquid height to an inner diameter of the vessel was 0.75/1 and the monomer solution contained 16% by weight of methanol. While the polymerization operation was continued for one year with a conversion of about 62%, no block mass was formed and polyvinyl acetate resin having a polymerization degree of about 2000 was produced.

Comparative Example

Figure 5:
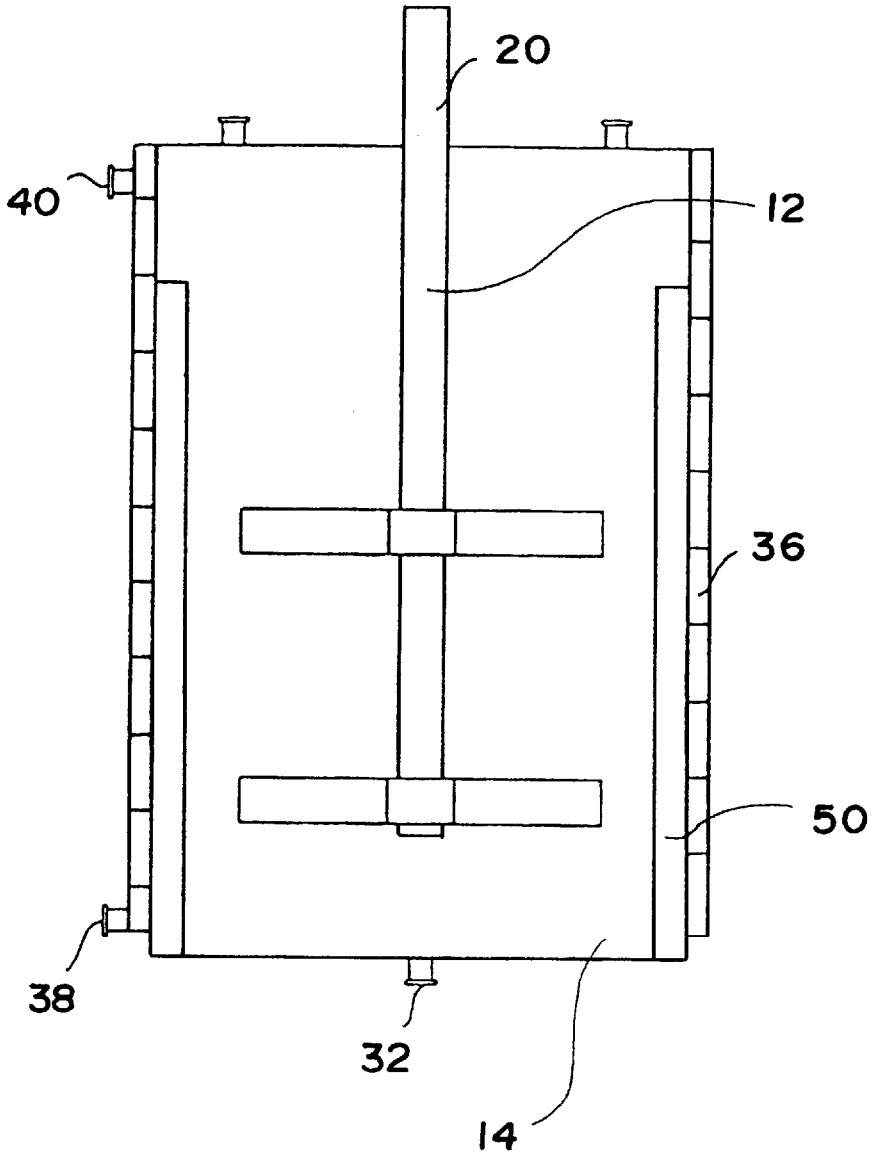
FIG. 5 PRIOR ART
FIG. 5 schematically shows a front view of a conventional mixing apparatus which was used in Comparative Example, which will be described later.

A mixing apparatus as shown in FIG. 5 was used which comprised an agitating element 12 of a paddle agitator type and a mixing vessel 14 having an inner diameter of 2400 mm and a height of 3600 mm and the vessel contained baffle plates 50. Operation conditions were the same as those in Example 1.

The polymerization operation was continued for 10 days and many block masses were formed and grew gradually so that power consumption for agitation increased. In addition, since the mixing effect depends on a position of a liquid portion relative to the agitating element, stable continuous operation was very difficult to maintain.

What is claimed is:

1. A polymerization agitating element for a mixing vessel substantially in the form of a cylinder, the mixing vessel defining an axis of rotation, said polymerization agitating element comprises: at least two bars in the form of a column or a cylinder; and at least one connecting member which connects said at least two bars to each other to form said polymerization agitating element such that loci of said at least two bars do not essentially coincide with each other when said at least two bars are rotated around the axis of the mixing vessel, and also such that a distance between the axis of the vessel and a center between the innermost and outermost of said at least two bars is in the range between 6% and 12% of the inside diameter of the vessel.

2. The polymerization agitating element according to claim 1, wherein the mixing vessel includes a rotative shaft which defines the axis of rotation of the mixing vessel, wherein said at least one connecting member connects said at least two bars parallel to each other, and wherein said polymerization agitating element further comprises: a connection mechanism, which fixes said at least one connecting member to the rotative shaft, such that the connection mechanism and the axis of rotation of the mixing vessel align with each other.

3. The polymerization agitating element according to claim 1, wherein said at least two bars and said at least one connecting member define an unobstructed passage for fluid.

4. A polymerization apparatus, comprising: a mixing vessel which is substantially in the form of a cylinder and defines an axis of rotation; and a polymerization agitating element, said polymerization agitating element comprising at least two bars in the form of a column or a cylinder and at least one connecting member which connects said at least two bars to each other to form said polymerization agitating element such that loci of said at least two bars do not essentially coincide with each other when said at least two bars are rotated around the axis of the mixing vessel, and also such that a distance between the axis of the vessel and a center between the innermost and outermost of said at least two bars is in the range between 6% and 12% of the inside diameter of the vessel.

5. The polymerization apparatus according to claim 4, wherein a clearance is defined between the inside wall of said mixing vessel and the outermost bar of said at least two bars which is closest to the inside wall, and wherein the width of said clearance is 0.2 to 0.4% of an inner diameter of said mixing vessel.

6. The polymerization apparatus according to claim 4, further comprising: means for admitting a solution for polymerization to said mixing vessel.

7. The polymerization apparatus according to claim 6, wherein said polymerization apparatus is adapted for solution polymerization of a vinyl ester monomer selected from the group consisting of vinyl acetate, vinyl propionate, vinyl butalate, vinyl versate and vinyl pivalate.

8. The polymerization apparatus according to claim 4, wherein said at least two bars and said at least one connecting member define an unobstructed passage for fluid.

* * * * *